United States Patent [19]

Reinker

[11] 3,943,714

[45] Mar. 16, 1976

[54] FAIL-SAFE LIMIT SWITCH STOPPING SYSTEM FOR AIR MOTOR

[75] Inventor: Ralph W. Reinker, San Jose, Calif.

[73] Assignee: The United States of America as represented by the Secretary of the Navy, Washington, D.C.

[22] Filed: Jan. 23, 1975

[21] Appl. No.: 543,612

[52] U.S. Cl. ..... 60/403; 60/406; 60/905; 91/461

[51] Int. Cl.[2] ..... F15B 20/00

[58] Field of Search ..... 60/370, 379, 403, 406, 60/407, 409, 460, 905; 91/461; 254/173 R

[56] References Cited

UNITED STATES PATENTS 3,301,532 1/1967 Lock et al. ..... 254/173 R 3,684,244 8/1972 Houck ..... 254/173 R

*Primary Examiner*—Edgar W. Geoghegan

*Attorney, Agent, or Firm*—R. S. Sciascia; Q. E. Hodges

[57] ABSTRACT

A valving arrangement for a winch motor powered by air or other pneumatic fluid. The valving arrangement includes normally closed valves in the working fluid lines which are held open by air in the pilot fluid lines. In the event of a rupture or break in the pilot line, a normally closed valve is allowed to close, thereby stopping the winch and preventing it from overrunning its travel limits.

4 Claims, 6 Drawing Figures

FAIL-SAFE LIMIT SWITCH STOPPING SYSTEM FOR AIR MOTOR

The invention described herein may be manufactured and used by or for the Government of the United States of America for governmental purposes without the payment of any royalties thereon or therefor.

BACKGROUND

Prior art winches which are operated by motors powered by air or other pneumatic fluids usually includes limit stops which limit the travel of the winch at its upper and lower points. These limit stops usually take the form of a normally open valve in the working fluid line immediately before the winch motor; when the limit stop is reached, another valve is opened which sends pilot fluid to the normally open valve which closes the valve thereby stopping the winch motor.

This type of limit stop arrangement works well unless there is a leak or break in the pilot fluid line leading to the valve in the working fluid line. When there is a leak or break in the pilot line, pilot fluid does not reach the valve and the valve does not close; thus the winch motor continues to turn, and the winch exceeds its limits of travel. This results in damage to the winch, other equipment, or personnel in the area.

Electrically operated limit switches are generally not feasible, since pneumatic powered equipment is usually used in those environments where the possibility of an electrical spark can not be tolerated. The use of an electric limit switch system would cancel out the safety feature of using the pneumatic powered winch rather than an electric powered winch.

The present invention is a valving arrangement for a pneumatic powered winch which eliminates the above drawback.

SUMMARY

Briefly, the present invention is a valving arrangement for a pneumatic powered winch which depends on the absence, rather than the presence, of pilot fluid to stop the winch motor. The final valve in the working fluid path is a normally closed valve which is held open by pilot fluid when the winch is operating. When the limit stop is reached, the supply of pilot fluid is cut off and the normally closed valve is allowed to close, stopping the winch. In the event of a leak or break in the line, pilot fluid will not reach the valve and the winch will stop at that point in its travel.

OBJECTS OF THE INVENTION

Accordingly, it is an object of the invention to provide an improved pneumatic powered winch motor.

It is further object of the present invention to provide a pneumatic powered winch motor having an improved limit switch system.

It is a further object of the present invention to provide a pneumatic powered winch motor having a fail-safe feature.

It is a further object of the present invention to provide a pneumatic powered winch motor which will stop in the event of loss of pilot fluid.

Other objects and advantages of the present invention will be obvious from the following specification and accompanying drawings.

DESCRIPTION OF THE PREFERRED EMBODIMENT

Figure 1:
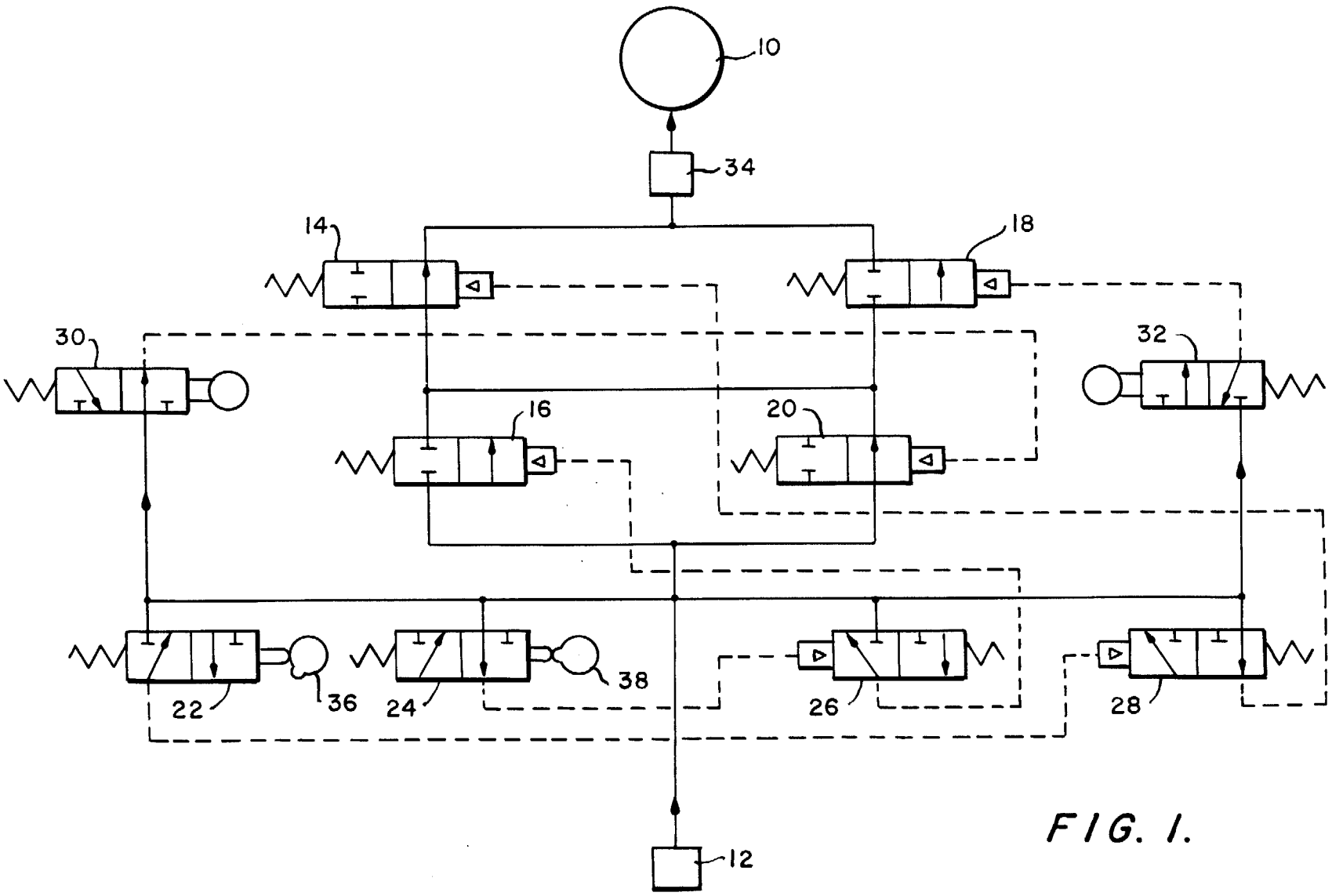
FIGS. 1–6 show the valving arrangement of the present invention.

The valving arrangement of the present invention will first be generally described with reference to FIG. 1; specific air flow paths will then be described with reference to FIGS. 1–6. In all of the figures, those lines which carry working fluid will be denoted as solid lines; those lines which carry pilot fluid will be denoted as dashed lines.

The following description will be directed to a motor for a winch; however, it is to be understood that the valving arrangement can be employed with any pneumatic motor wherein it is necessary or desirable that the motor automatically stop in the event of a leak or break in the pneumatic lines. The valving schematic diagram can also be used with a hydraulic motor, although the valves called for later are not intended for use with hydraulic fluid; additionally, the present schematic does not porvide for the return of vented hydraulic fluid to the reservoir.

The winch is preferably the type wherein the cable drum remains in one place and the cable is paid out from or wound onto it; the words "up" and "down" then refer to the position or direction of motion of the item being raised or lowered by the winch motor. However, any other type of winch can be used with the present invention.

The present invention comprises a reversible winch motor 10 powered by air or other pneumatic or hydraulic fluid, and suitable valves direct it into the motor. Pneumatic or hydraulic fluid, which for convenience will be referred to as air, is supplied by a compressor 12.

The valving arrangement can be broken down into four groups of valves. Group 1 comprises the four main air valves 14, 16, 18 and 20. Group 2 comprises the two limit stop valves, 22 and 24. The third group is the transfer valves 26 and 28. The fourth group is the manually operated throttle control valves 30 and 32. In addition, there is a directional valve and a poppet shut-off valve associated with the winch motor which are shown schematically as item 34 and which form no part of the present invention.

There is also a brake on the winch drum; the operation of this brake is the same as in the prior art, hence it is not shown.

Main air valves 14-20 are normally closed valves such as Ross Operating Valve C. Model 2651-a-5001 or equivalent which are opened by pilot actuators as shown. Limit stop valves 22 and 24 are normally closed valves such as Bellows-Valvair Model N144-1001 or equivalent which are opened by cams 36 and 38, respectively, which are driven by the gearing of winch 10. Transfer valves 26 and 28 are normally open valves such as Clippard Instruments Lab. Model-3 or equivalent which are closed by pilot actuators as shown. Throttle control valves 30 and 32 are normally closed valves such as Clippard Instruments Lab. Model MJV-4 or equivalent which are manually opened. These latter valves are operated by movement of the throttle arm which is actuated by pulling on the "up" or "down" control rope. The directional valve and poppet valve 34 are also actuated by pulling on the control ropes and are arranged such that the poppet valve opens to allow air to flow into the directional valve which is positioned to direct air into the motor to rotate it in the desired direction. The physical interconnection of the poppet valve and directional valve with the throttle control valves is well known in the art and is not discussed here.

Operation of the valve arrangement will now be described, beginning with FIG. 1.

The drawings sequentially depict a complete cycle of operation, wherein the winch load goes from the top of its travel down to the bottom and then back up to the top. Only those valves are discussed with change their position from one Figure to the next. In this Figure the winch load is at the top of its travel; the lobe on cam 38 has moved normally closed upper limit stop valve 24 to the open position, which sends pilot air to normally open transfer valve 26, closing it. This stops the flow of pilot air to normally closed main air valve 16, which allows it to close. Limit stop valve 22 is closed, cutting off the flow of pilot air to normally open transfer valve 28; transfer valve 28 opens, which directs pilot air to normally closed main air valve 14, opening it and allowing air to pass to winch motor 10. However, no air can get to valve 14 until the winch "down" rope (not shown) is pulled, which opens normally closed throttle control valve 30 as shown. This send pilot air to normally closed main air valve 20, opening it, and allows air to pass through it to main air valve 14. Thus when the down rope is pulled, working air passes through valves 20 and 14 into winch motor 10. However, if there should be a leak or break in the pilot line leading from transfer valve 28 to main air valve 14 or if one should develop while the winch is in operation, main air valve 14 will close (or never open) and the winch will stop.

Figure 2:
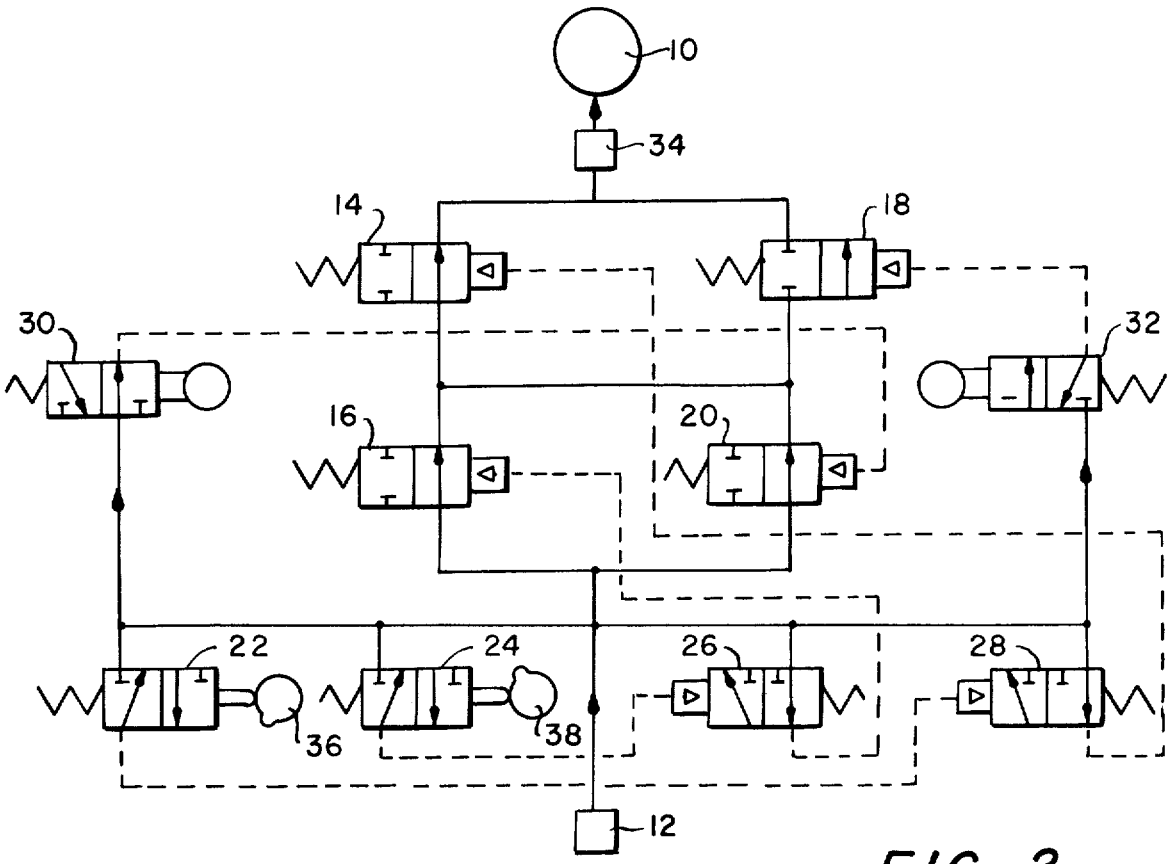

In FIG. 2 it is assumed that the winch has rotated enough to move the lobe on cam 38 off valve 24, allowing it to close. This stops the flow of pilot air to normally open transfer valve 26, allowing it to open. This passes pilot air to normally closed main air valve 16, opening it, and sets up a second path for air to reach main air valve 14. It is assumed that throttle control valve 30 is still being held open manually be pulling on the "down" rope. The winch motor will continue to operate until the lower limit stop is reached or the "down" rope is released.

Figure 3:
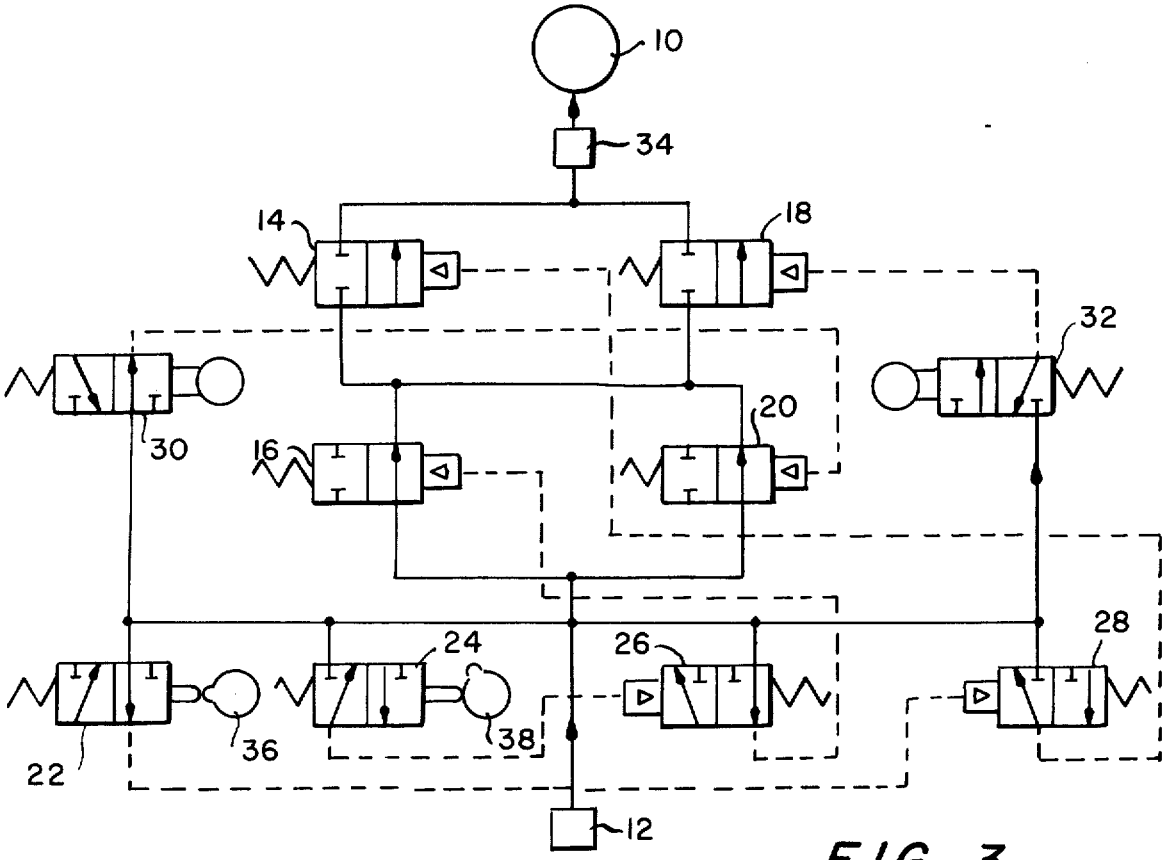

In FIG. 3 it is assumed that the winch has rotated enough to cause the lobe on cam 36 to open normally closed lower limit stop valve 22, sending pilot air to normally open transfer valve 28, closing it. This stops the flow of pilot air to normally closed main air valve 14, allowing it to close, thereby stopping the winch in its travel. Normally closed main air valve 16 remains open, since pilot air is supplied by transfer valve 26 which is normally open.

Figure 4:
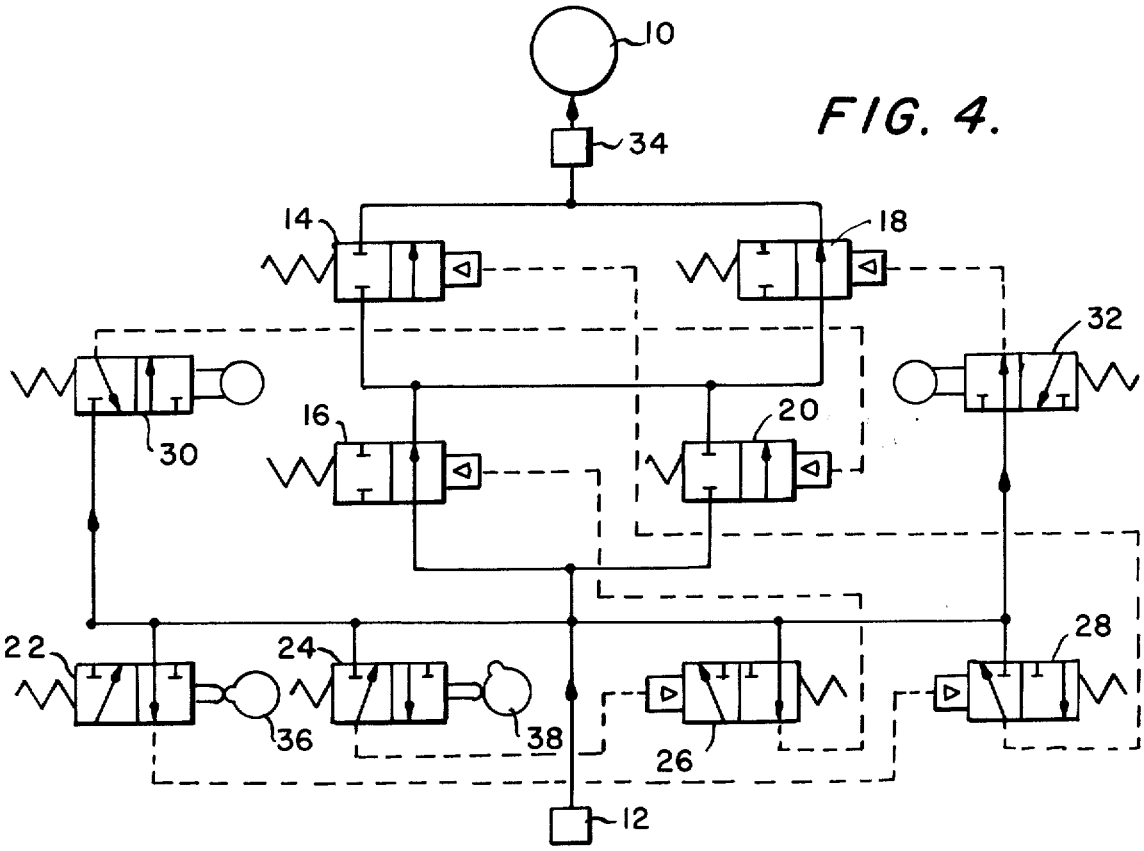

In FIG. 4 it is assumed that the winch "up" throttle rope (not shown) is pulled, opening valve 32. This sends pilot air to normally closed main air valve 18, opening it, and allows working air to pass through valves 16 and 18 to winch motor 10. The winch now begins to move up, and will continue to move up until the upper limit stop is reached or the "up" rope is released.

However, if there is a leak or break in the pilot line leading to normally closed main air valve 18 when the up rope is pulled, the valve will not open and the winch will not move. If the leak or break should develop after the winch starts to move, valve 18 will automatically close and stop the winch at that point in its travel.

Figure 5:
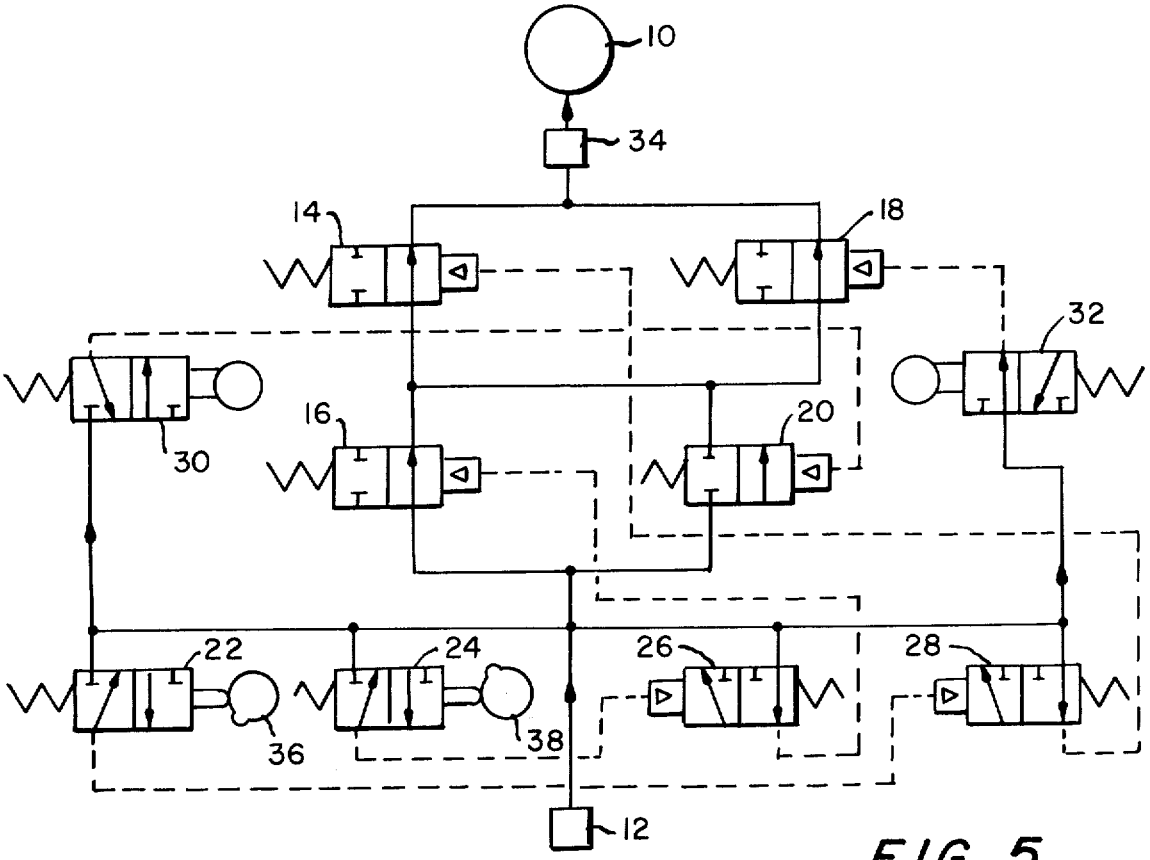

In FIG. 5 it is assumed that the winch has rotated enough to move the lobe on cam 36 off valve 22, allowing it to close. This stops the flow of pilot air to normally open transfer valve 28, allowing it to open and sends pilot air to normally closed main air valve 14, opening it. This establishes a second path for working air to reach winch motor 10; through valves 16 and 14 into the winch motor, and through valves 16 and 18 into the winch motor. Valve 32 is still manually held open.

Figure 6:
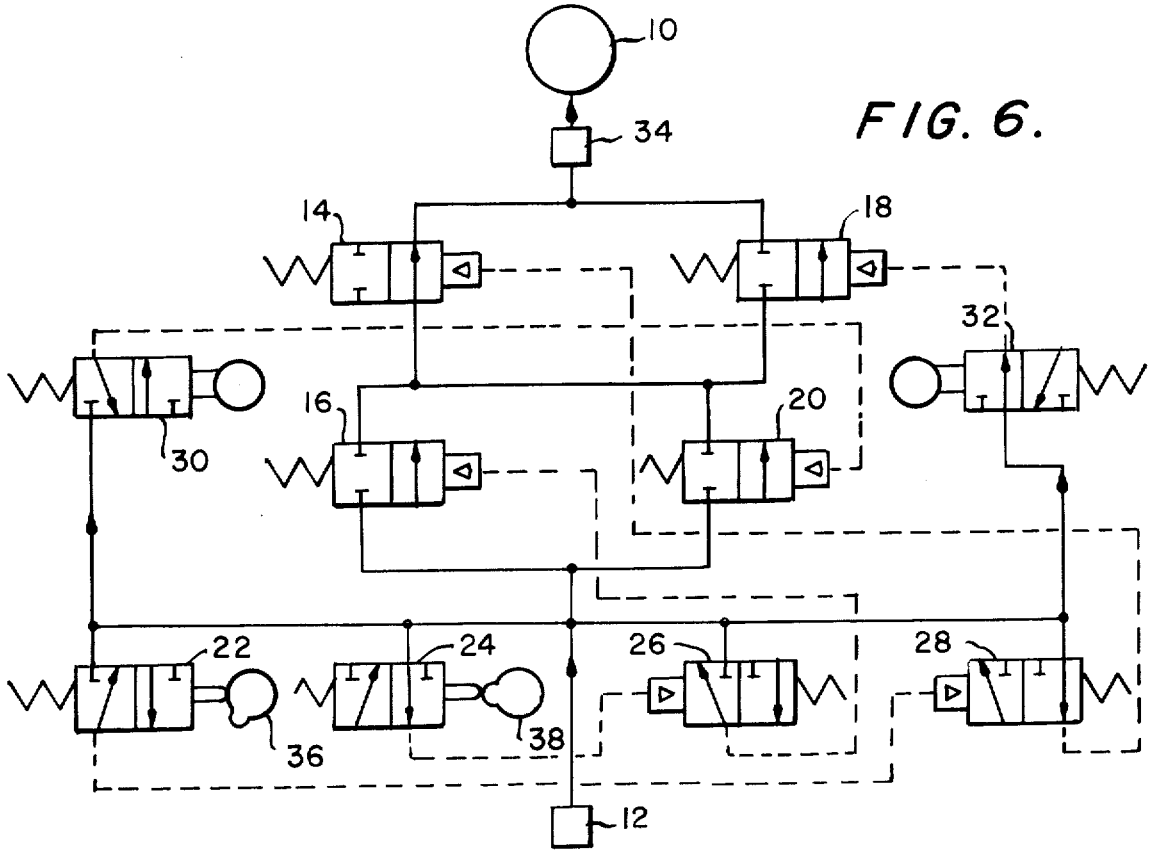

The winch motor will continue to operate until the lobe on cam 38 has rotated enough to open normally closed upper limit stop valve 24 as shown in FIG. 6, which will then send pilot air into normally open transfer valve 26, closing it and stopping the flow of pilot air to normally closed main air valve 16. Normally closed main air valve 16 will then close, stopping the winch at its upper limit of travel.

Obviously many modifications and variations of the present invention are possible in light of the above teachings. It is therefore to be understood that within the scope of the appended claims the invention may be practiced otherwise than as specifically described.

What is claim is:

1. In a pneumatic powered which system, a control circuit comprising:

a source of pneumatic fluid;

pneumatic power fluid and pneumatic control fluid supplies derived from said source of pneumatic fluid;

a pneumatic motor operated by said pneumatic power fluid;

pneumatic limit switches operated by said pneumatic control fluid which limit the operation of the winch;

and means responsive to a lack of pneumatic control fluid which stop the operation of the winch;

said means comprising normally closed valves placed in the pneumatic power fluid lines.

2. A pneumatic powered winch as in claim 1 wherein said normally closed valves are held open by said pneumatic control fluid.

3. A pneumatic motor control system comprising:

a source of fluid;

a pneumatic motor operated by said pneumatic fluid;

a plurality of normally closed valves in the fluid lines leading to said motor;

a plurality of normally open valves in parallel with said normally closed valves, the output from said normally open valves being used to open certain of said normally closed valves;

normally closed cam-opened valves in parallel with said normally closed valves the output from which is used to close said normally open valves;

and normally closed manually opened valves in parallel with said normally closed valves the output from which is used to open the others of said normally closed valves to thereby control the direction of operation of the motor.

4. A fluid motor control system comprising:

a source of pressurized fluid;

a fluid motor connected to said source to be driven by said pressurized fluid;

a first group of fluid actuated valves connected by fluid lines to said source and said motor to control the flow of fluid to said motor;

a second group of fluid actuated valves connected by fluid lines to said source and said motor in parallel with said first group of valves;

a bypass fluid line interconnecting said parallel lines at a point intermediate two of the valves in each of said groups;

a pair of manually operated valves each of which is connected to admit control fluid to one of the valves in said first group of fluid actuated valves, to control the flow of fluid to said motor;

a pair of fluid actuated valves each of which is connected to provide control fluid to one of the valves in said second group of fluid actuated valves;

a pair of cam actuated valves, each of which admits control fluid to one of said pair of fluid actuated valves, said cams being driven by said motor; and means connecting all of said valves to the source of pressurized fluid;

said first and said second groups of valves being of the normally closed type and said pair of fluid actuated valves and said pair of cam actuated valves being of the normally open type;

said valves being positioned such that a loss of pressure in one of the control fluid lines allows its associated normally closed valve to close, thereby stopping the operation of the fluid motor.

* * * * *